US008061548B1

(12) United States Patent
Peggs

(10) Patent No.: US 8,061,548 B1
(45) Date of Patent: Nov. 22, 2011

(54) SEGREGATION DISK FOR A COLLAPSIBLE CONTAINER

(76) Inventor: John David Peggs, Fort Lauderdale, FL (US)

( * ) Notice: Subject to any disclaimer, the term of this patent is extended or adjusted under 35 U.S.C. 154(b) by 523 days.

(21) Appl. No.: 12/205,856

(22) Filed: Sep. 6, 2008

(51) Int. Cl.
*B65D 25/04* (2006.01)
*B65D 85/00* (2006.01)

(52) U.S. Cl. ..... 220/530; 220/523; 220/525; 220/526; 220/528; 220/529; 220/666; 206/538

(58) Field of Classification Search ..... 220/523, 220/525, 526, 528, 529, 530, 666; 206/528, 206/538; 215/6
See application file for complete search history.

(56) References Cited

U.S. PATENT DOCUMENTS

| | | | | |
|---|---|---|---|---|
| 0,197,760 | A | | 12/1877 | Brewer |
| 1,048,935 | A | | 12/1912 | Brady |
| 2,139,143 | A | | 12/1938 | Wiswell |
| 2,432,025 | A | | 12/1947 | Lorenz |
| 2,685,316 | A | | 8/1954 | Krasno |
| 2,886,084 | A | | 5/1959 | Davison |
| 2,899,110 | A | | 8/1959 | Parker |
| 2,962,187 | A | | 11/1960 | Morris |
| 3,155,281 | A | | 11/1964 | Stracey |
| 3,285,459 | A | | 11/1966 | Gahm |
| 3,301,293 | A | | 1/1967 | Santelli |
| 3,311,129 | A | | 3/1967 | Binder |
| 3,434,589 | A | | 3/1969 | Valtri et al. |
| 3,833,154 | A | | 9/1974 | Markowitz |
| 3,939,887 | A | * | 2/1976 | Scarnato ..... 220/666 |
| 4,044,836 | A | | 8/1977 | Martin |
| 4,204,611 | A | | 5/1980 | Graves |
| 4,372,445 | A | | 2/1983 | Keffeler |
| 4,381,059 | A | | 4/1983 | Schurman |
| 4,394,906 | A | | 7/1983 | Hollenbeck |
| 4,492,313 | A | | 1/1985 | Touzani |
| 4,735,318 | A | | 4/1988 | Keffeler |
| 4,749,085 | A | | 6/1988 | Denney |
| 4,793,492 | A | | 12/1988 | Halbich |
| 4,809,877 | A | | 3/1989 | Albright |
| 4,873,100 | A | | 10/1989 | Dirksing et al. |
| 4,875,576 | A | | 10/1989 | Torgrimson et al. |
| 4,940,138 | A | | 7/1990 | Hornstein |
| 4,955,493 | A | | 9/1990 | Touzani |
| 5,002,193 | A | | 3/1991 | Touzani |
| 5,199,590 | A | | 4/1993 | Grandahal et al. |
| 5,201,438 | A | | 4/1993 | Norwood |
| 5,240,130 | A | | 8/1993 | Osbakk |
| 5,269,428 | A | | 12/1993 | Gilbert |
| 5,322,166 | A | | 6/1994 | Crowther |

(Continued)

FOREIGN PATENT DOCUMENTS

| | | |
|---|---|---|
| GB | 294 187 | 7/1928 |

(Continued)

*Primary Examiner* — Anthony Stashick
*Assistant Examiner* — Madison L Wright
(74) *Attorney, Agent, or Firm* — Michael I. Kroll

(57) ABSTRACT

A segregation disk and method of separately storing items in a collapsible, tubular container uses segregation disks for segregating the collapsible container into multiple chambers of user-selectable size. The segregation disks are generally planar disks having a diameter slightly greater than the interior diameter of the container, and formed of a flexible material that have a plurality of radial slits extending inwardly from their periphery to form a plurality of flexible wedges. At the terminus of each radial slit is a tear break, generally a circular hole. An integral pull tab extends from a peripheral region of one of the flexible wedges to facilitate removal.

12 Claims, 8 Drawing Sheets

U.S. PATENT DOCUMENTS

| | | | | |
|---|---|---|---|---|
| 5,402,714 | A * | 4/1995 | Deneault et al. | 99/416 |
| 5,549,213 | A | 8/1996 | Robbins, III et al. | |
| 5,782,372 | A | 7/1998 | Weiss et al. | |
| 5,850,919 | A * | 12/1998 | Freed | 206/534 |
| 6,105,815 | A | 8/2000 | Mazda | |
| 6,126,010 | A | 10/2000 | Kogen | |
| 6,202,224 | B1 | 3/2001 | Freeman | |
| 6,293,403 | B1 | 9/2001 | Holmberg | |
| 6,736,285 | B2 | 5/2004 | Stewart-Stand | |
| 6,898,899 | B2 | 5/2005 | Weder | |
| 7,004,324 | B1 | 2/2006 | Delorio | |
| 7,866,500 | B1 | 1/2011 | Peggs | |
| 2006/0065590 | A1 | 3/2006 | Scharf | |

FOREIGN PATENT DOCUMENTS

| | | |
|---|---|---|
| GB | 557 857 | 12/1943 |
| GB | 1 125 488 | 8/1968 |
| GB | 2 376 877 | 12/2002 |

* cited by examiner

SEGREGATION DISK FOR A COLLAPSIBLE CONTAINER

BACKGROUND OF THE INVENTION

1. Field of the Invention

The present invention relates generally to containers and, more specifically, to a disk for a collapsible container composed of a bendable material having a plurality of radial slits that form flexible wedges around its periphery, that are designed to flex independently inwardly or outwardly while being pushed into place within a tube, or pulled out of place via a pull tab. At the terminating end of each radial slit a "tear break" is provided by means of a hole that prevents the slits from tearing during flexure in or out of a container. The segregation disks of the present invention have a structure that is easily insertable and securable to a desired location within a tube, while allowing for easy removal of a placed and secured disk by action of pulling a pull tab. Additionally the present invention is made of a single body construction whereby the provided pull tab is an integral component of a wedge portion of the present invention.

2. Description of the Prior Art

There are other storage devices designed for similar purposes. Typical of these is U.S. Pat. No. 1,048,935 issued to Brady on Dec. 31, 1912.

Another patent was issued to Wiswell on Dec. 6, 1938 as U.S. Pat. No. 2,139,143. Yet another U.S. Pat. No. 2,685,316 was issued to Krasno on Aug. 3, 1954 and still yet another was issued on May 12, 1959 to Davison as U.S. Pat. No. 2,886,084. Another U.S. Pat. No. 2,899,110 was issued to Parker on Aug. 11, 1959.

Another patent was issued to Stracey on Nov. 3, 1964 as U.S. Pat. No. 3,155,281. Yet another U.S. Pat. No. 3,285,459 was issued to Gahm on Nov. 15, 1966. Another was issued to Santelli on Jan. 31, 1967 as U.S. Pat. No. 3,301,293 and still yet another was issued on Mar. 25, 1969 to Valtri et al. as U.S. Pat. No. 3,434,589.

Another patent was issued to Markowitz on Sep. 3, 1974 as U.S. Pat. No. 3,833,154. Yet another U.S. Pat. No. 3,939,887 was issued to Scarnato on Feb. 24, 1976. Another was issued to Martin et al, on Aug. 30, 1977 as U.S. Pat. No. 4,044,836 and still yet another was issued on May 27, 1980 to Graves as U.S. Pat. No. 4,204,611.

Another patent was issued to Keffeler on Feb. 8, 1983 as U.S. Pat. No. 4,372,445. Yet another U.S. Pat. No. 4,381,059 was issued to Schuman on Apr. 26, 1983. Another was issued to Hollenbeck on Jul. 26, 1983 as U.S. Pat. No. 4,394,906 and still yet another was issued on Jan. 8, 1985 to Touzani as U.S. Pat. No. 4,492,313.

Another patent was issued to Keffeler on Apr. 5, 1988 as U.S. Pat. No. 4,735,318. Yet another U.S. Pat. No. 4,749,085 was issued to Denney on Jun. 7, 1988. Another was issued to Halbich on Dec. 27, 1988 as U.S. Pat. No. 4,793,492 and still yet another was issued on Mar. 7, 1989 to Albright as U.S. Pat. No. 4,809,877.

Another patent was issued to Dirksing et al, on Oct. 10, 1989 as U.S. Pat. No. 4,873,100. Yet another U.S. Pat. No. 4,875,576 was issued to Torgrimson et al. on Oct. 24, 1989. Another was issued to Hornstein on Jul. 10, 1990 as U.S. Pat. No. 4,940,138 and still yet another was issued on Sep. 11, 1990 to Touzani as U.S. Pat. No. 4,955,493.

Another patent was issued to Touzani on Mar. 26, 1991 as U.S. Pat. No. 5,002,193. Yet another U.S. Pat. No. 5,201,438 was issued to Norwood on Apr. 13, 1993. Another was issued to Osbakk on Aug. 31, 1993 as U.S. Pat. No. 5,240,130 and still yet another was issued on Dec. 14, 1993 to Gilbert as U.S. Pat. No. 5,269,428.

Another patent was issued to Crowther on Jun. 21, 1994 as U.S. Pat. No. 5,322,166. Yet another U.S. Pat. No. 5,549,213 was issued to Robbins et al. on Aug. 27, 1996. Another was issued to Weiss et al. on Jul. 21, 1998 as U.S. Pat. No. 5,782,372 and still yet another was issued on Aug. 22, 2000 to Mazda as U.S. Pat. No. 6,105,815.

Another patent was issued to Kogen on Oct. 3, 2000 as U.S. Pat. No. 6,126,010. Yet another U.S. Pat. No. 6,202,224 was issued to Freeman on Mar. 20, 2001. Another was issued to Holmberg on Sep. 25, 2001 as U.S. Pat. No. 6,293,403 and still yet another was issued on May 18, 2004 to Stewart-Stand as U.S. Pat. No. 6,736,285.

Another patent was issued to Weder on May 31, 2005 as U.S. Pat. No. 6,898,899. Yet another U.S. Pat. No. 7,004,324 was issued to Delorio on Feb. 28, 2006. Another was issued to Hutt on Jul. 20, 1928 as UK Patent No. GB 294,187 and still yet another was issued on Dec. 8, 1943 to Coomber as UK Patent No. GB 557,857. Another was issued to Gahm on Aug. 28, 1968 as UK Patent No. GB 1,125,488 and still yet another was issued on Dec. 31, 2002 to Miller as UK Patent No. GB 2,376,877.

U.S. Pat. No. 1,048,935
Inventor: John F. Brady
Issued: Dec. 31, 1912

A drinking cup embodying a base plate with a marginal bead, a collapsible cup on said base plate, a housing member inclosing the cup and comprising a body portion with a side provided near its marginal edge with a resilient internal curved flange forming a seat for said bead, and means for releasing said bead from its seat comprising a spring plate having a portion secured to the inner face of said body and a releasing wedge movable with said spring plate and having a portion projecting through the side wall of the housing.

U.S. Pat. No. 2,139,143
Inventor: Norman N. Wiswell
Issued: Dec. 6, 1938

A container having a foldable side wall of readily bendable and collapsible material creased over substantially the entire length of the container with a plurality of substantially parallel fold initiating creases extending around the side wall, said creases having a plurality of intermissions which occur at several points about the circumference of the wall, all in such manner that the container may be substantially collapsed by endwise pressure, with the side wall material between said parallel creases, and also at the intermissions in each crease, bending reversely to the direction of deformation of said fold initiating creases.

U.S. Pat. No. 2,685,316
Inventor: Louis R. Krasno
Issued: Aug. 3, 1954

A container for perishable products comprising a body including a bottom wall, spaced parallel side walls, and connecting flexible end walls, a flexible filling neck carried by the upper ends of the side and end walls, and a removable sealing closure for the neck, and connecting end walls being provided with vertically extending accordion pleats running from the bottom wall to the neck, whereby the connecting end walls can be collapsed upon pressure being applied to the side walls for bringing said side walls toward one another.

U.S. Pat. No. 2,886,084
Inventor: Delphine L. Davison
Issued: May 12, 1959

A portable container including a base, a top, and an upright accordion-like wall structure of pliable, moisture-proof material connected at its lower end to the base and at the upper end to said top, the wall structure including an accordion-like inner wall and a similar outer wall in a spaced relation to said inner wall, coil spring means in the space between the inner wall and the outer wall, the spring means bearing at the lower end against said base and bearing at the upper end against said top, and urging the top in a direction away from the base, the top being provided with a central aperture opening into the space surrounded by the inner wall, air valve means in the top for passage of air into or out of the space between the outer wall and the inner wall, and a removable closure for the aperture in said top, the accordion-like wall structure being adapted to be collapsed against the resistance of the spring means by manual pressure upon the top towards the base.

U.S. Pat. No. 2,899,110

Inventor: Carol Parker

Issued: Aug. 11, 1959

A dispensing container comprising a generally circular top, a generally circular bottom and a generally conical side wall of flexible resilient material connecting the peripheral portions of said top and bottom, said side walls comprising a plurality of side by side integrally formed pleats, each of said pleats consisting of an inwardly and upwardly sloping upper strip wall and an inwardly and downwardly sloping lower strip walls of each pleat intersecting to define an outwardly projecting hinged connection, and the inner edges of the strip walls of said pleats intersecting to define an inwardly projecting hinged connection, said strip walls being approximately flat in transverse direction and being adapted to be brought into close face to face relation by the action of said hinged connections without exceeding the elastic limit thereof in response to collapsing movement applied to said top and bottom the degree of conicity of said walls being sufficient to permit said inwardly projecting hinged connections to substantially contact said bottom when said container is collapsed.

U.S. Pat. No. 3,155,281

Inventor: John Stracey

Issued: Nov. 3, 1964

A novel container for powders, pastes, and liquids, comprising a main chamber having a substantially flexible resilient wall member in the form of a continuous helical bellows biased to expand position by the inherent resiliency of said wall member, a base open at the top and having an inner side wall having a larger diameter than said wall member, a closed bottom and internal threads on said base spaced upwardly from said bottom and spaced inwardly from said inner side wall, said internal threads cooperating with the lower end of said resilient wall member to connect said base to said wall member, said wall member being adapted to be screwed into and thereby collapsed within said base, the upper end of said chamber being provided with means for dispensing the contents of said chamber.

U.S. Pat. No. 3,285,459

Inventor: Wilbert J. Gahm

Issued: Nov. 15, 1966

In a collapsible multicompartment container, the combination comprising: a base member, a vertically oriented circumferential wall extending upwardly from said base at right angles thereto to define a cup-shaped portion, a second wall attached to said base within said circumferential wall and coaxial therewith, said second wall extending angularly upwardly and outwardly from said base and defining a second cup-shaped portion, a plurality of rings of progressively larger diameter than said second wall at its point of interconnection with said base which may be elevated progressively to engage each other and said second wall to define a receptacle of increasing diameter, a complementary cover for said container including a top portion and downwardly extending side wall portions, frictionally cooperable with said circumferential wall on said base to define a container therewith, said cover portion further including a second wall extending vertically downwardly from said top in parallel relation to said side wall portions to define an inverted container within said cover, a closure member for said cover container including an upwardly directed side wall portion adapted to frictionally embrace said second wall of said cover container, said closure member having a diameter greater than the inner diameter of said second cup-shaped portion in said base at the point of interconnection of said second wall and said base but lesser than the inner diameter of said second cup-shaped portion at its uppermost extremity, whereby said closure member will be retained in position on said wall of said cover container by said wall of said second cup-shaped portion in said base when said cover and said base are interconnected, and indicating indicia on said closure member and said wall of said cover container to indicate times for use of materials contained within said cover container.

U.S. Pat. No. 3,301,293

Inventor: Thomas R. Santelli

Issued: Jan. 31, 1967

A collapsible container comprising opposite top and bottom walls and a flexible side wall interconnecting said top and bottom walls to enclose a space, said side wall having a plurality of longitudinally spaced bellows-like pleats each defined by a ridge and outwardly extending wall portions converging at the ridge, and interlocking means formed on a number of adjacent pairs of said pleats for retaining the container in any selected one of a plurality of collapsed positions, U.S. Pat. No. 3,434,589

Inventor: Frank J. Valtri et al.

Issued: Mar. 25, 1969

A throw-away personal-use container of resilient plastic material comprising a compressible-expandable cup; said cup having a bottom, an annular wall, and a removable cap; said cup having a bottom, an annular wall, and a removable cap; said annular wall alternately decreasing and increasing diametrically, forming accordion-like folds; said bottom being provided with a pair of individual wells each of a size and shape adapted for receiving with clearance an individual tablet or pellet; said cap, when said cup is fully compressed, closing each well to retain the tablet therein; and means retaining said cup in fully compressed condition pending use of said tablets.

U.S. Pat. No. 3,833,154

Inventor: Isral J. Markowitz

Issued: Sep. 3, 1974

A collapsible dispensing container wherein a container body is provided with an opening having a discharge member engaged over the opening, and in the opening is a one-way valve resiliently biased to permit fluent material movement outwardly upon collapse of the container body and prevent fluent material entry to the body.

U.S. Pat. No. 3,939,887

Inventor: Thomas J. Scarnato

Issued: Feb. 24, 1976

A self-expandable, foldable and reusable container made of elastic material which is adapted to be collapsed progressively from top to bottom to a volumetric dimension substantially equal to the substance contained therein to minimize air space in the container. An air tight closure is tightened about an access opening in said container while the same is held in collapsed condition. The folds of said container are formed with sections of different geometry to effect progressive flexibility from the top to the bottom thereof.

U.S. Pat. No. 4,044,836
Inventor: Edward J. Martin
Issued: Aug. 30, 1977

A dispenser for dry powders, and in particular for fire extinguishing powders, formed as a container having a handle/nozzle section to be gripped by one hand, a hand gripping section to be gripped by the other hand, and a central bellows section for alternate axial compression and expansion to pump the powder from the container and thereby to discharge it in repeated cloud-like bursts. By regulating the quantity of powder in the dispenser and the powder dispensing opening it is possible to repeatedly discharge fire extinguishing effective amounts of a fire extinguishing powder. In one preferred embodiment the handle/nozzle section is configured as an elongated conical member.

U.S. Pat. No. 4,204,611
Inventor: Joel S. Graves
Issued: May 27, 1980

A product dispenser for dispensing products, such as tablets, on a time related schedule, or randomly as desired, comprising a generally cylindrical product receiving magazine having a plurality of axially spaced groups of circumferentially spaced, radially outwardly opening, product receiving pockets which are generally in axial alignment with the pockets of adjacent groups to form circumferentially spaced rows of pockets; a plurality of product retaining rotatable rings mounted on the magazine in radial alignment with the pockets for retaining the tablets in the pockets; each ring including a tablet dispensing aperture therethrough adapted to be moved into alignment with a selected one of the pockets; a plurality of axially spaced indicia, representing the days of the week, lying in the planes of the groups of pockets; and circumferentially spaced indicia, representing different time periods throughout the day, generally longitudinally aligned with the rows of pockets.

U.S. Pat. No. 4,372,445
Inventor: Paul J. Keffeler
Issued: Feb. 8, 1983

A medication dispenser includes a container defining a plurality of open topped medication compartments adapted to be closed by a compartment cover assembly including a plurality of individual covers connected together by fracturable links. Each cover includes an integral fracturable tab depending from one end and coacting means on the container and tabs for securing the tabs in snap-fit relation when the cover is positioned to close its respective compartment. Thus each tab is independently secured relative to the container and fractured from its respective cover in response to upward movement of the opposite end of the cover to open the compartment.

U.S. Pat. No. 4,381,059
Inventor: Edwin A. Schuman
Issued: Apr. 26, 1983

Easy opening article storing and dispensing containers and method in which puzzle-like locking means secure against access to the container contents by very young children by obscuring the mode of opening it. The annular container shell has closable dispensing aperture means opening through the shell side wall. Locking means at one or more ends of the shell optionally prevents or permits opening and closing of the container by alignment or offset of release means with respect to a sliding means. Pills or other units may be segregated in separate amounts or dosages within the container and dispensed in predetermined sequence from a plurality of rings of radially openable compartments forming a stack in which rows of compartments around the container axis can be rotated to sequentially register with the aperture means and compartments of each row sequentially opened.

U.S. Pat. No. 4,394,906
Inventor: John C. Hollenbeck
Issued: Jul. 26, 1983

Food container/holder formed from foamed polymer and having a body portion of ascending corrugated bands for extruding food under hand pressure.

U.S. Pat. No. 4,492,313
Inventor: William Touzani
Issued: Jan. 8, 1985

A collapsible or foldable plastic bottle of circular bellows like configuration capable of manufacture on current plastic bottle manufacturing equipment with current plastic materials approved for contact with foods and beverages. The bellows over center and fold to retain the folded condition without external assistance thus providing a self-latching feature. In particular, the bellows of the bottle, when fully folded, cause the bottle to substantially fit within a cup fastened to the base of the bottle. The cup is generally formed by further extending the cup upward and increasing the diameter slightly in comparison with the reinforcing cup on current soda pop bottles.

U.S. Pat. No. 4,735,318
Inventor: Paul J. Keffeler
Issued: Apr. 5, 1988

A medication dispenser includes a reusable container adapted to receive one or more disposable multicompartment liners for sanitary storage of medication out of contact with the reusable container. The open-topped compartments of the liners are closed by individual covers which are locked onto the container with a fracturable tab which must be broken to open a compartment. Each cover has a depending peripheral flange adapted for insertion into a peripheral channel around each compartment of the liner to form an air-tight seal for tamper-proof sanitary airtight storage of a patient's medication.

U.S. Pat. No. 4,749,085
Inventor: James D. Denney
Issued: Jun. 7, 1988

A rectangular, open-top shallow tray with enclosing side walls has markings designating each day of the week equally spaced across the top and a set of individual compartments or pill boxes for each day of the week resting in the tray in line with each of the designated days of the week and frictionally and removably held in place in the tray so that each of the set of pill boxes can be separately and individually removed from the tray whereby the user can conveniently carry prescribed medication for a given day separate from the other days of the week.

U.S. Pat. No. 4,793,492
Inventor: Frank Halbich
Issued: Mar. 7, 1989

An improved homecare pillbox containing a plurality of compartments for pills or the like arranged, indexed and differentiated in units for use over a selected period of time such as a week, and for providing proper medication in accurate doses to patients, whether supervised or unsupervised; readily releasable means for securing together any number of such units for holding several types of medication to be taken at different times during the day; and cover means for easy opening and access and for storing and protecting medication.

U.S. Pat. No. 4,809,877
Inventor: Marie O. Albright
Issued: Mar. 7, 1989

A device for dispensing medicament capsules is set forth which includes a housing within which are disposed a plurality of vertically spaced and substantially parallel transverse dispensing gates. Each dispensing gate has a like number of apertures extending vertically through the gate and spaced at different radial distances from the housing axis where the radial distances are of equal length in each one of the plurality of gates. Those apertures located at equal radial distances in successive dispensing gates are spaced in a radial sequence of equal angles. Between each successive dispensing gate a removable and reloadable carriage member is located which is contiguous with the dispensing gate and each carriage member has a multiplicity of radially spaced slots extending vertically through the carriage member for storage of medicament capsules. The slots are sequentially located concentrically about the vertical axis at radial distances equal to those radial distances locating a dispensing gate aperture. The carriage members are connected together to permit vertical alignment of the carriage member slots such that upon rotation of the carriage members, the slots remain in vertical alignment. A programmable motor is also provided to index or rotate the carriage members whereby upon open alignment of any carriage member slot with a dispensing gate aperture the capsules contained in the slot will pass downwardly through the dispensing gate.

U.S. Pat. No. 4,873,100

Inventor: Robert S. Dirksing et al.

Issued: Oct. 10, 1989

A bistable expandable bottle preferably including a concentrated material to be diluted, said bottle being comprised of convex shaped bellows when in its expanded condition, said bottle also including opposed handle means for facilitating the extension of the bottle from its collapsed to its expanded condition. In a preferred embodiment a self-venting closure is also employed to seal the orifice in said bottle to permit extension of the bottle from its collapsed to its expanded condition without loosening or removing of the closure.

U.S. Pat. No. 4,875,576

Inventor: Lee A. Torgrimson et al.

Issued: Oct. 24, 1989

A mixing kit for beverages or other mixtures is disclosed. Such a kit includes a predetermined volume of a first substantially non-gaseous mixture component. The first mixture component is adapted for combination with a second liquid mixture component in a predetermined mixture ratio. A volume expandable enclosure is included for retaining the mixture components. The enclosure defines a predetermined condensed enclosure volume sufficient to retain the volume of the first mixture component, and a predetermined expanded enclosure mixture volume. The mixture volume is sufficient to retain both the first and second mixture components in the desired predetermined ratio.

U.S. Pat. No. 4,940,138

Inventor: Allan S. Hornstein

Issued: Jul. 10, 1990

A cylindrical tube having a removable end closure at a first end and a collapsible drinking cup inserted in a second end is provided as a storage container for miscellaneous items such as first aid components. In its collapsed state, the collapsible drinking cup functions as an end plug for the container and in its extended state, it is a liquid tight cup for use with the container contents.

U.S. Pat. No. 4,955,493

Inventor: William N. Touzani

Issued: Sep. 11, 1990

A collapsible plastic hollow article having a top and a base joined by a substantially cylindrical side wall integral therewith and an aperture in the top, comprising a plurality of substantially circular bellows formed by conical sections integrally joined to create at least a portion of the side wall, the conical sections comprising alternating short portions and long portions, said short portions being at a greater angle to the bottle axis than said long portions, and the lesser diameter junctures of the long portions with the short portions being formed to create fold rings for the substantially circular bellows, wherein means for connecting a suction cup to said base.

U.S. Pat. No. 5,002,193

Inventor: William N. Touzani

Issued: Mar. 26, 1991

A collapsible, expansible, plastic hollow article having a top and a base joined by a substantially cylindrical side wall integral therewith and an aperture in the top, comprising a plurality of substantially circular bellows formed by conical sections integrally joined to create at least a portion of the article side wall, the conical sections comprising alternating short portions and long portions, said short portions being at a greater angle to the article axis than said long portions, and the lesser diameter junctures of the long portions with the short portions being formed to create fold rings for said substantially circular bellows. A handle means comprising a clip snugly fits in between adjacent conical sections joined by a lesser diameter juncture, and a grip having a further support at a lower point of the side wall. Thus the hollow article can be held in a straight configuration.

U.S. Pat. No. 5,201,438

Inventor: Peter M. Norwood

Issued: Apr. 13, 1993

A multi-faceted collapsible container has a sidewall of joined-together rings comprised of pyramidal segments having peaks extending outwardly. Each segment is comprised of four polygonal facets; the upper pair of facets is longer than the lower pair. Sufficient vertical force causes the smaller lower facets to fold under the longer upper facets, collapsing the rings and the sidewall of the container.

U.S. Pat. No. 5,240,130

Inventor: Georg Osbakk

Issued: Aug. 31, 1993

A compressible body comprising a container and a flexible annular wall member, and the container, in turn, includes a cylindrical side wall and a prestressed locking member. The side wall of the container forms an upper edge and defines a cylindrical space having a given circumference, and the locking member of the container is mounted on the upper edge of the side wall and is inherently biased radially inwardly toward a position inward of that given circumference. The wall member of the bottle is mounted inside the container of the bottle, and that wall member has extended and compressed positions. In the extended position, the wall member extends upward from the container; and in the compressed position, the wall member is at least substantially contained within the container and the upper portion of the wall member is below the locking member of the container. Moreover, when the wall member is compressed into its compressed position, the locking member moves radially inwardly, due to is inherent resiliency, to a locking position in which the locking member extends directly over the upper portion of the wall member and locks that wall member inside the container.

U.S. Pat. No. 5,269,428

Inventor: Neil Y. Gilbert

Issued: Dec. 14, 1993

A collapsible container having at least one helical preferential fold region that enables a user to gradually and fixedly increase or decrease the internal volume of the container. A cup section is used to act on the collapsible container to cause folding or unfolding of the collapsible container's side wall.

U.S. Pat. No. 5,322,166

Inventor: Jonathan M. Crowther

Issued: Jun. 21, 1994

A pill storage and dispensing container has a lower storage unit with a plurality of radially arranged individual pill storage compartments. An upper storage unit positioned directly above and nestled within the lower unit also has a plurality of similarly arranged storage compartments as well as one bottomless compartment. A top cover is positioned directly above the upper storage unit, and a dispensing opening in the cover is arranged to communicate with the various compartments in the upper unit as well as with the bottomless compartment and the various compartments of the lower storage unit as the cover is rotated relative to the storage units. A hub shaft releasably interconnects the upper and lower storage units and the top cover while allowing the storage units and cover to rotate relative to on another. Twenty eight individual storage compartments are provided in a compact container which enables pills to be dispensed four times per day over a seven day period.

U.S. Pat. No. 5,549,213

Inventor: Edward S. Robbins III et al.

Issued: Aug. 27, 1996

A container and associated cap assembly includes a container body having an open upper end defined by an annular rim, the rim having a substantially horizontal uppermost edge surface and a radially outwardly and downwardly extending bevelled surface. The cap has a top wall, a radially outer depending skirt portion and a radially inner depending skirt portion. The skirt portions are connected radially by an internal cap surface which includes a first substantially horizontal surface portion extending radially away from the radially inner skirt; a second downwardly and outwardly inclined sealing surface portion, and a third radiused surface portion connected to the radially outer skirt. The second downwardly and outwardly inclined sealing surface is sealingly engageable with the bevelled surface of the annular rim such that the substantially horizontal uppermost edge surface is axially spaced from the cap top wall upon full threaded engagement between said cap and said container body.

U.S. Pat. No. 5,782,372

Inventor: Marla Weiss et al.

Issued: Jul. 21, 1998

A carrying case which can be opened or collapsed is disclosed. The carrying case has at least a first nestable module and a second nestable module. The first module has a bottom portion which has an inward projection. A side portion of the first module has a compartment which can be withdrawn from the first module. A second module has a top portion which has an outward projection and a side portion of the second module has a compartment which can be withdrawn from the second module, wherein the outward and inward projections of the first and second modules cooperate as a stop means for controlling the opening of the carrying case. The first and second modules are nestable within one another and are adapted to slidably collapse into one another and slidably open into a position to provide access to the compartments.

U.S. Pat. No. 6,105,815

Inventor: Masayosi Mazda

Issued: Aug. 22, 2000

A port closure is a combination which includes a tank, a closure member and an actuator. The tank has defining walls, an exterior surface, an interior surface, an interior cavity and an access port. The closure member is disposed within the interior cavity of the tank. The closure member has an access port engaging face that is larger than a cross-sectional area of the access port. The actuator is coupled with the closure member and moves the closure member between a first position in which the access port engaging face closes the access port and a second position laterally spaced from the access port.

U.S. Pat. No. 6,126,010

Inventor: Robert A. Kogen

Issued: Oct. 3, 2000

A combination pill dispenser and collapsible drinking cup unit. The unit includes an elongated hollow body, a first removable cap member, a second removable cap member, a pill organizer, and a collapsible cup. The hollow body has an outer wall including opposed first and second ends and an end wall located adjacent the first forming a hollow chamber in which the pill organizer is located. A first removable cap is provided to close the chamber in which the organizer is located. The organizer includes a plurality of wedge-shaped compartments formed by plural wall panels radiating outward from a central post. The post projects upward from a circular, planar base member. A circular, planar cover is rotatably mounted on the post and includes a wedge shaped opening in its periphery. The opening is arranged to selectively communicate with a respective one of the compartments when the cover is rotated to a desired orientation. The second cap member has an end wall and a peripheral flange, and is arranged for releasable securement to the first end of the hollow body. The collapsible cup is located on the end wall of the second cap member and within the bounds of the peripheral flange. The collapsible cup is formed of plural conical shaped sections which are nested together and arranged to be moved from the nested position to an extended position to form a leak-proof cup.

U.S. Pat. No. 6,202,224

Inventor: Ronald A. Freeman

Issued: Mar. 20, 2001

A portable container for disposing of liquid waste products is disclosed having an expandable container into which an impermeable liner is inserted. The liner is secured to the container to prevent spillage and leaks. Furthermore, a water soluble gel pack is placed in the liner such that when a liquid waste product is deposited into the liner, the water soluble gel pack dissolves and the gel powder contained therein reacts with the liquid waste product thereby transforming it into a gel form, a solidified waste product, for easy disposal. The liner containing the solidified waste product is removed from the expandable container and disposed of by conventional means, enabling in the expandable container to be reused with a new liner and water soluble gel pack.

U.S. Pat. No. 6,293,403

Inventor: Douglas A. Holmberg

Issued: Sep. 25, 2001

A system to organize, store and dispense a plurality of tablets in a predetermined therapeutic regime comprising a plurality of sets of separate packets corresponding to the days of the week or the dates of the month configured to store at least one tablet therein wherein each set of separate packets comprises a subset of the packets corresponding to the time of day or date the plurality tablets for the corresponding day or date are to be administered and a packet organizer to arrange the sets and subsets of packets sequentially by day or date and time of day or date for each corresponding day or date for selectively dispensing and consumption of the appropriate tablet or tablets at the proper time and day or date.

U.S. Pat. No. 6,736,285
Inventor: Theo A. Stewart-Stand
Issued: May 18, 2004

A floral container sized to contain a flower pot or a growing medium and a plant, the floral container having a base and a detachable upper portion constructed in the configuration of an accordion fold which can be expanded vertically. The floral container may optionally have a skirt portion.

U.S. Pat. No. 6,898,899
Inventor: Donald E. Weder
Issued: May 31, 2005

A floral container sized to contain a flower pot or a growing medium and a plant, the floral container having a base and a detachable upper portion constructed in the configuration of an accordion fold which can be expanded vertically. The floral container may optionally have a skirt portion.

U.S. Pat. No. 7,004,324
Inventor: Lorraine Delorio
Issued: Feb. 28, 2006

A multi-compartment pill container constructed to hold a week's worth of medication for a user. The container has a housing having a top surface, a number of removable compartments held within the rectangular openings in the top surface of the housing, and a lid attached to the housing and extending over the compartments. Each compartment is divided into chambers by separation walls. Each chamber has a chamber cover on which indicia is printed. The indicia includes abbreviations for the days of the week for each of the compartments, as well as times of the day for each of the chambers. At the correct time, the user ingests the medication from the appropriate chamber. The container also includes a telescopic drinking cup to aid in the taking of medication and a timer to notify the user to take the medication. Each compartment may be completely removed from the housing to allow the user to carry the compartment separate from the entire container.

U.K. Patent Number GB 294,187
Inventor: Arthur Cyril Hutt
Issued: Jul. 20, 1928

Collapsible tubes or containers of the kind which are provided with a stiff outer casing, in order to avoid the shapeless and unsightly appearance of the container when partially empty. The container is of annular cross-section, having a rigid outer wall and a collapsible inner wall, between which the material is enclosed. The inner wall is corrugated longitudinally, and can be distended outwardly towards the outer wall by means of a follower, in order to expel the material. A container of this form, having both walls collapsible, may be held in a stiff outer casing, formed with a bulge, into which the outer wall of the container is forced when pressure is applied, so as to lock the two parts of the device together. A collapsible container, of bellows form is provided with a deformable rib, which can be pressed into a groove at the upper end of a stiff outer casing. The container may comprise a flanged body part, and a separate end-member, which can rest upon a shoulder on a stiff outer casing. The rim of the casing is then turned over, so as to clamp the parts together. The collapsible container may be of telescopic form.

U.K. Patent Number GB 557,857
Inventor: Cyril Everard Renton Coomber
Issued: Dec. 8, 1943

A collapsible container for liquids comprises a flexible collapsible body portion of rubber or rubberized canvas afforded by strip connected by bands, end members of similar but stiffer material, one of them being provided with filling and vent openings, detachable stay members adapted to be housed in sockets and engaged by rings attached to the corrugations to hold the container in distended condition and to be disposed together in a pair of similar sockets provided on the end, to serve as a handle for the collapsed container, straps being provided to hold the container in the collapsed condition.

U.K. Patent Number GB 1,125,488
Inventor: Wilbert Joseph Gahm
Issued: Aug. 28, 1968

A collapsible container comprises a base member to the base of which is secured a collapsible container made up of telescoping rings which extend to form a cup, and a cover comprising a cup-shaped receptacle portion, closable by a cover and in which pills may be kept. The cover is marked to cooperate with an index mark on the wall of the receptacle to indicate for example the time for taking the next pill.

U.K. Patent Number GB 2,376,877
Inventor: Austen Charles Miller
Issued: Dec. 31, 2002

A container is formed from end pieces rotated at 90 degrees relative to each other, spaced apart by six resilient rods of carbon- or glass-fibre reinforced material. Textile panels interpose the rods, and alternate panels are a gauze fabric to allow air movement. The rods are located in pockets stitched on the hexagonal end pieces. Pushing the end pieces together in a twisting motion collapses the container into a planar configuration. The textile panels are wider at the middle than the ends, and form a skewed parallelogram. The hems between the panels are stitched with pockets for the rods. A loop can be provided to hang the container, and a hook within can be used to hang items stored inside. A closure allows access to the interior. When extended, the container has a twisted bowed shape.

While these containers may be suitable for the purposes for which they were designed, they would not be as suitable for the purposes of the present invention, as hereinafter described.

SUMMARY OF THE PRESENT INVENTION

A primary object of the present invention is to provide a disk with a plurality of wedge portions used for segregation between areas within a collapsible bellows type storage tube.

Another object of the present invention is to provide a wedged segregation disk having a plurality of radial slits that cooperatively form a plurality of flexible wedges therebetween.

Yet another object of the present invention is to provide a wedged segregation disk having a plurality of holes or "tear breaks" made into the terminating ends of the slits as to prevent the slit from continuing into a tear under flexing conditions.

Still yet another object of the present invention is to provide a segregation disk having a pull tab that is integral to the disk as an extending length of material originating projecting out of the end of a defined wedge portion.

Another object of the present invention is to provide a collapsible bellows type storage tube having a plurality of segregation disks that are easily placed and replaced to define and redefine the sizes of regions within the tube to the user's specifications.

Yet another object of the present invention is to provide a collapsible bellows type storage tube having separate flexible plastic disks as segregating spacers that are placed inside the device creating separate spaces for a plurality of items to be placed within each chamber.

Additional objects of the present invention will appear as the description proceeds.

The present invention overcomes the shortcomings of the prior art by providing a plurality of segregation disks used in conjunction with a collapsible tubular container whereby said disks have a plurality of radiating slits, defining wedges therebetween and having holes serving as tear breaks made at the terminating ends of said slits. The disks are easily placeable and replaceable within the tube due to the ability of the wedges to flex independently when being pushed into a tube or pulled out via its integral pull tab.

The foregoing and other objects and advantages will appear from the description to follow. In the description reference is made to the accompanying drawing figures, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing figures, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
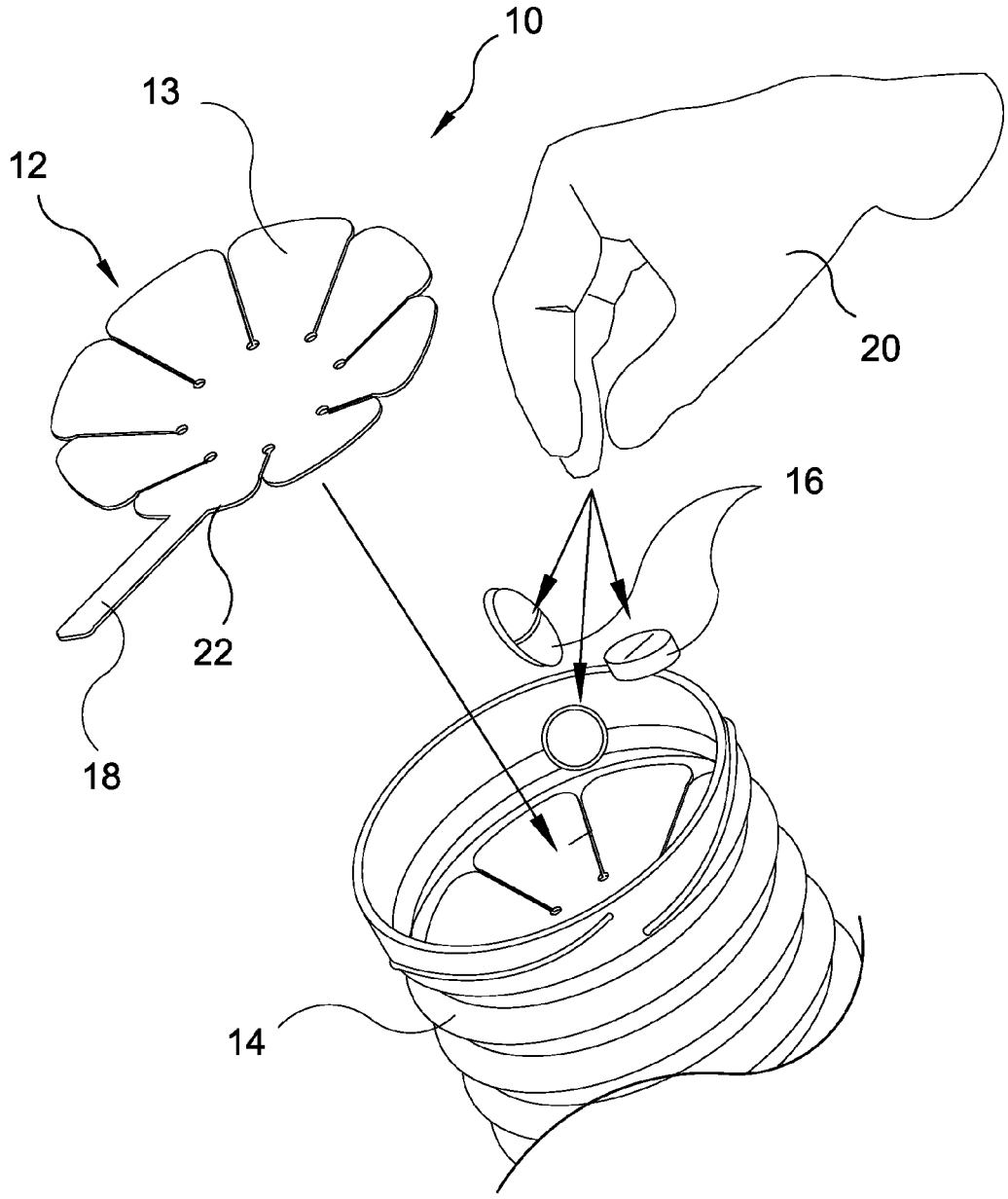
FIG. 1 is an illustrative view of the present invention.

Turning now descriptively to the drawings, in which similar reference characters denote similar elements throughout the several views, the figures illustrate the Segregation Disk for a Collapsible Container of the present invention. With regard to the reference numerals used, the following numbering is used throughout the various drawing figures.

10 Segregation Disk for Collapsible Containers of the present invention
12 segregation disk
13 wedge of 12
14 collapsible tube-like container
16 storable object
18 pull-tab
20 user
22 peripheral region of 13
24 tear break
26 radial slit
30 terminus of 26
32 polymeric material
34 storage compartment
36 compartment segregation disk
38 cover segregation disk
40 first segregation disk
42 center segregation disk
44 third segmentation disk

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of the present invention 10. Shown is the present invention 10 being a segregation disk 12 having a plurality of wedges 13 for use with a collapsible tube-like container 14. A segregation disk 12 is shown being inserted by the user 20 to define a first boundary of a region, wherethen said region may be occupied by small storable objects 16 such as pills, tablets, etc. then sealed within said region by a second disk 12 inserted to present a second boundary or cover. The segregation disks 12 may further include a pull tab 18 projecting from the wedge periphery 22.

Figure 2:
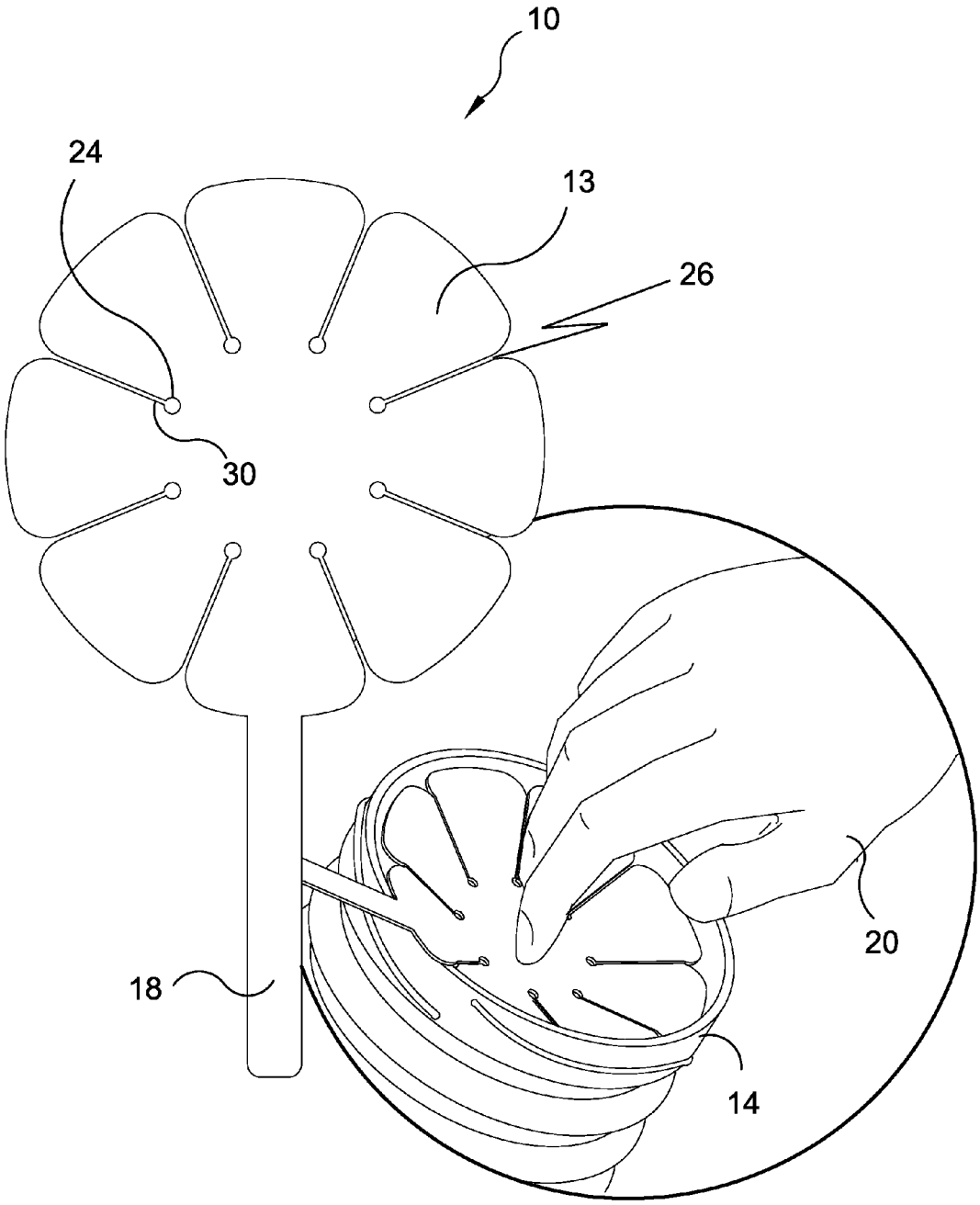
FIG. 2 is an illustrative view of the present invention.

FIG. 2 is an illustrative view of the present invention 10. Shown is an illustrative view of the insertable segregation disk 12 for a collapsible tube-type container 14 whereby the structure of the disk 12 can present a barrier within the container 14 to segregate it into specific user 20 defined regions. The disk 12 is separated into a plurality of wedge portions 13 that flex independently in order to allow the disk 12 to be pushed through freely to a desired point. The wedges are defined by slits 26 extending radially a terminus 30 having a circular tear break 24 disposed thereat. In order to remove the disk 12 a pull tab 18 is integrally formed with one said wedge portion 13 that can be pulled to dislodge the disk 12. The disks 12 are preferably formed of a polymeric material 32, for example, rubber, plastic or the like.

Figure 3:
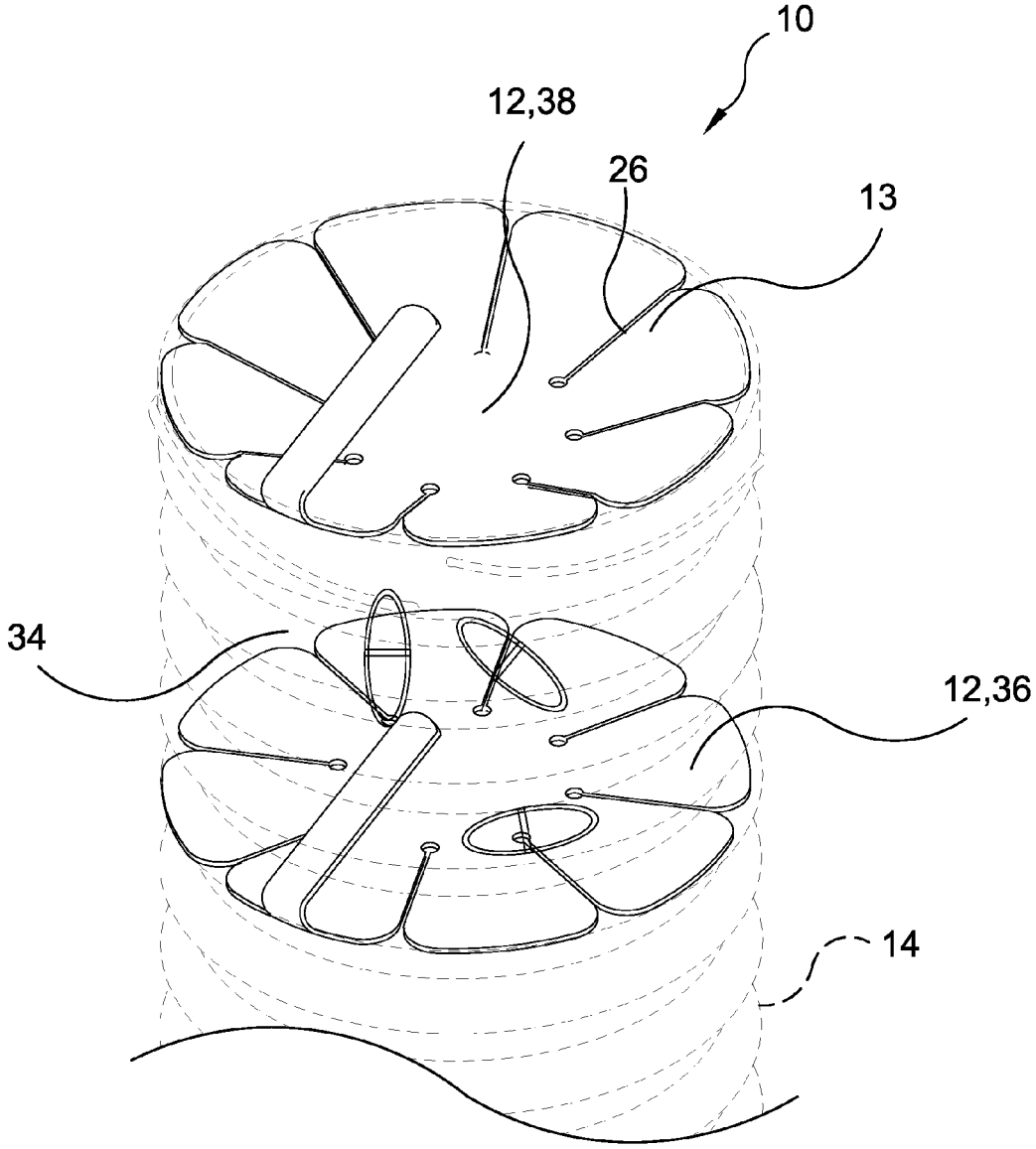
FIG. 3 is a top perspective view of the present invention.

FIG. 3 is a top perspective view of the present invention 10. Shown is the present invention 10 having a plurality of disks 12 having a plurality of cuts or slits 26 made into them defining wedges 13 so that while set in place, the overlapping wedges 13 provide a flat barrier but while pushed upon, the wedges 13 flex out of the way to effectively reduce its diameter to allow the disk to descend into the tube 14 to a desired point where a barrier or cover is needed. The disks 12 could be used as a compartment segregation disk 36 to separate storage compartments 34 or as a segregation disk cover 38 to seal the ends of the collapsible tube 14.

Figure 4:
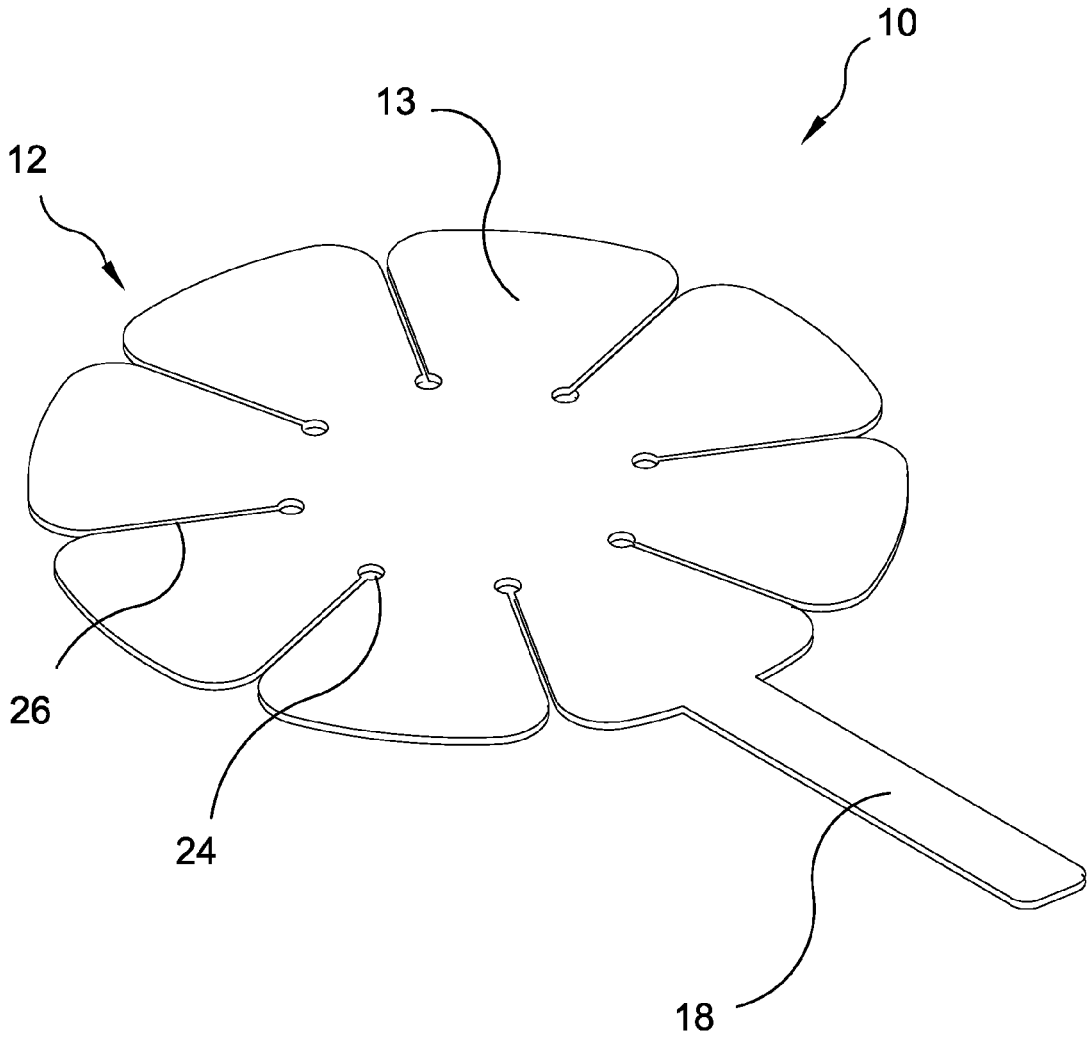
FIG. 4 is an illustrative view of the present invention.

FIG. 4 is an illustrative view of the present invention 10. Shown is the segregation disk 12 having a plurality of wedges 13 separated by slits 26 with tear breaks 24 designed to flexibly give way when pushed into the top opening of a collapsible tube container and including a pull-tab 18 for easy removal.

Figure 5:
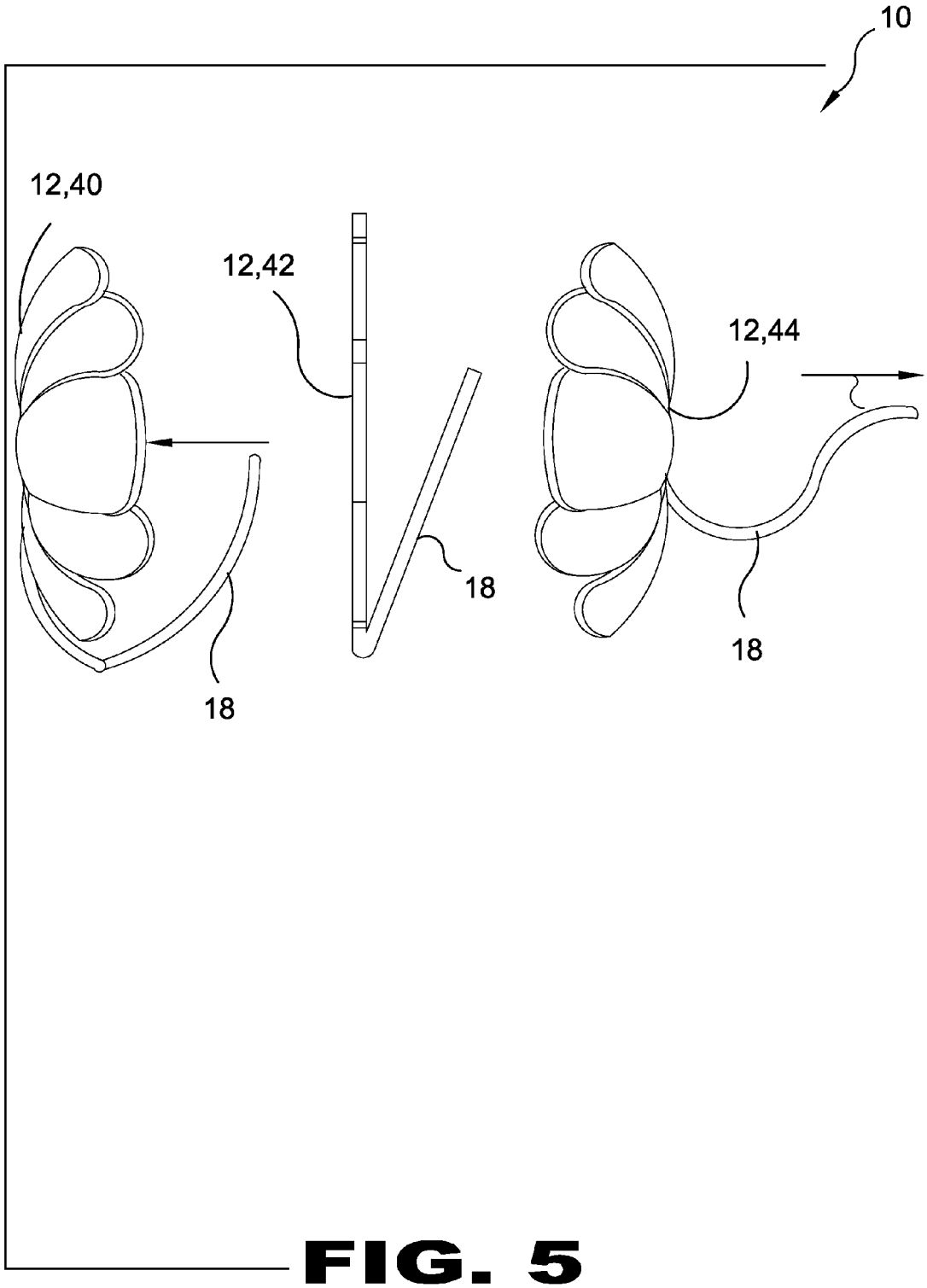
FIG. 5 is an illustrative view of the disks of the present invention.

FIG. 5 is an illustrative view of the disks 12 of the present invention 10. Shown are the disks 12 in three different physical states. The first disk 40 is distorted in a shape taken by the disk 12 while flexing to be inserted, the center disk 42 is set in place and unaffected, and the third disk 44 is being pulled and removed via a pull tab 18.

Figure 6:
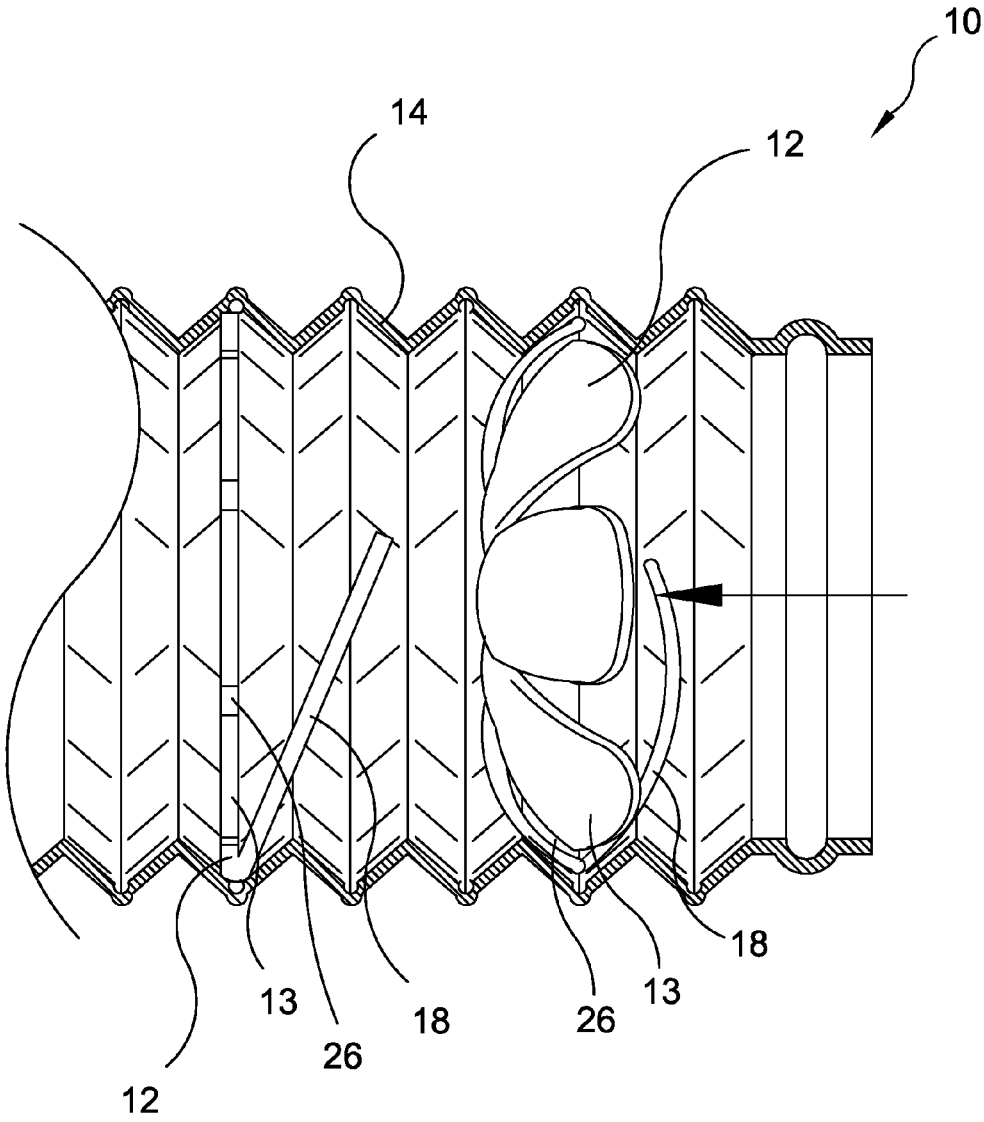
FIG. 6 is a side sectional view of the present invention.

FIG. 6 is a side sectional view of the present invention 10. Shown is a plurality of disks 12 being inserted into the tubular collapsible container 14 of the present invention 10. When a disk 12 is being inserted, the slits 26 allow the wedge portions 13 to distort allowing the disk 12 to slide down the tube 14 to wherever it is desired to be. The pull-tab 18 enables the user to easily remove the disks 12 from the container 14.

Figure 7:
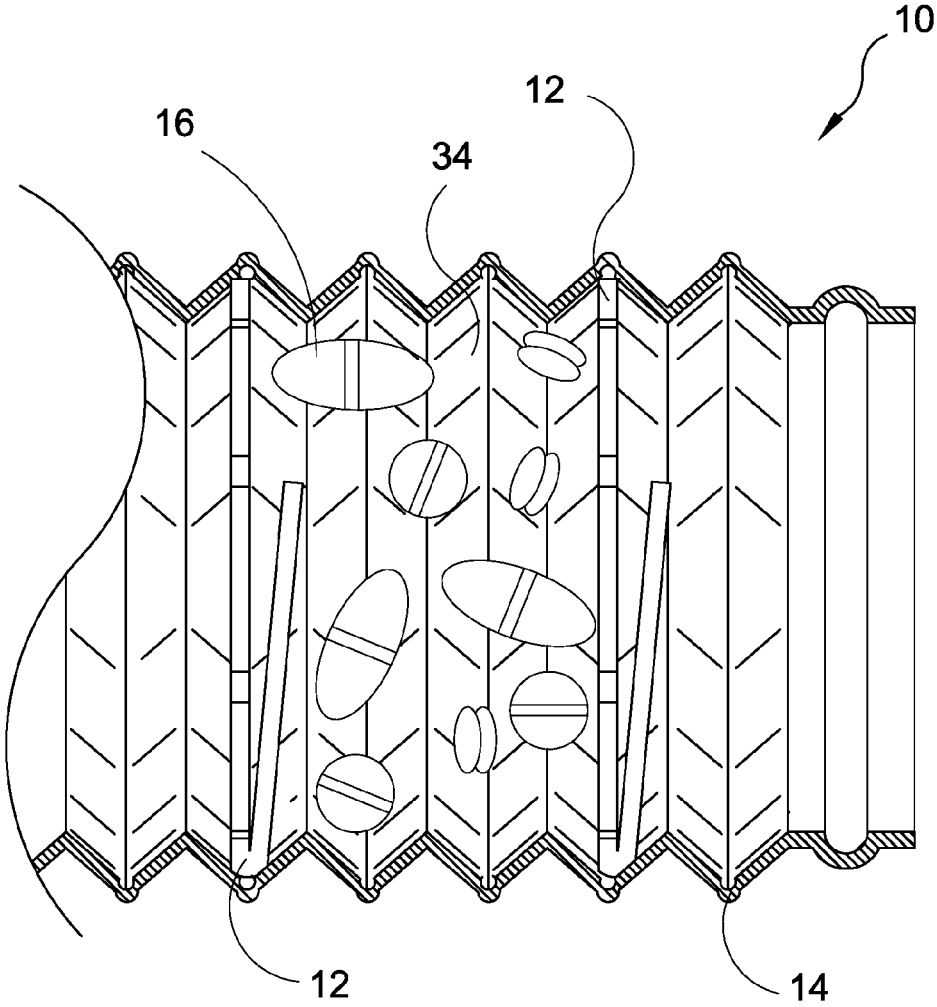
FIG. 7 is a side sectional view of the present invention.

FIG. 7 is a side sectional view of the present invention 10. Shown is the present invention 10 having a plurality of disks 12 inserted to segregate user specific compartments 34 within the collapsible container 14. The compartments 34 of the collapsible container 14 are segregated to hold and sort storable objects 16 such as pills, tablets, small items and the like.

Figure 8:
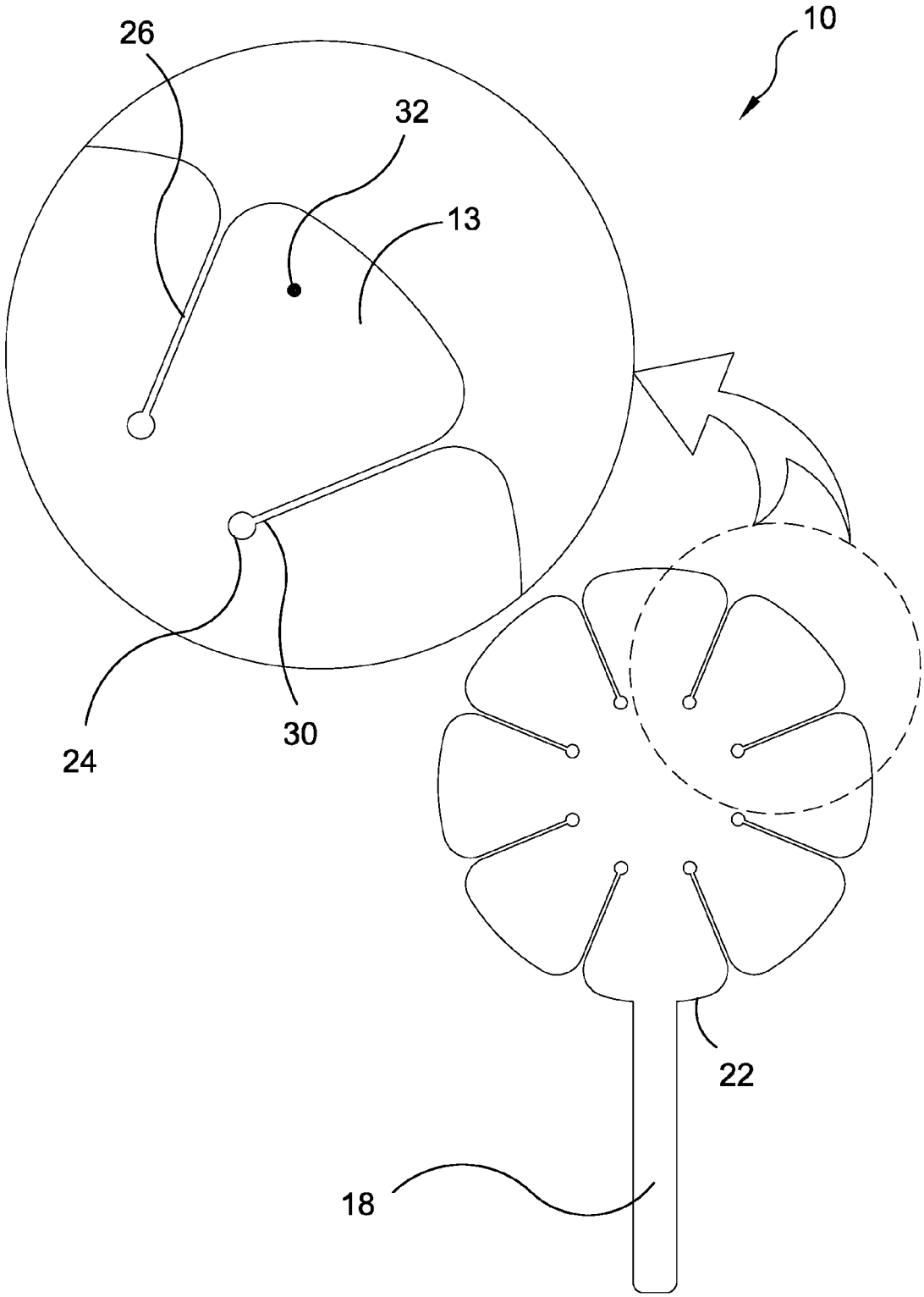
FIG. 8 is a detailed view of the tear breaks of the present invention.

FIG. 8 is a detailed view of the tear breaks 24 of the present invention 10. Shown are the wedges 13 with the tear breaks 24 located at the terminus ends 30 of the wedge slits 26. The tear breaks 24 are simply apertures at the terminus 30 of the slits 26 that aid in preventing the continued split of the material polymeric material 32 while flexing. The pull-tab 18 extends outward from the peripheral region 22 of one wedge 13.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A multi-chambered storage container system comprising:

a) a tubular container having a generally circular cross-section and an open end for inserting items to be stored; and b) a plurality of segregation disks for segregating said container into multiple chambers, said segregation disks being generally planar disks having a diameter greater than that of said tubular container, formed of a bendable material and having a plurality of radial slits extending inwardly from a periphery of said disk to form a plurality of flexible wedges therein;

c) said generally tubular container having an open top end and a closed bottom end;

d) said generally tubular container is collapsible from top to bottom;

e) said generally tubular container comprises a plurality of accordion-like folds which enable it to collapse or expand from top to bottom;

f) each of said radial slits extends from a periphery of said disk to a terminus at an interior portion of said disk;

g) a tear break at each said terminus; and h) wherein each said tear break is a generally circular aperture.

2. A multi-chambered storage container system according to claim 1, wherein said segregation disks further comprise an integral pull tab.

3. A multi-chambered storage container system according to claim 2, wherein said pull tab extends from a peripheral region of one of said flexible wedges of said segregation disk.

4. A multi-chambered storage container system according to claim 3, wherein said flexible wedges formed by said radial slits in said segregation disks have rounded corners at their periphery.

5. A multi-chambered storage container system according to claim 4, wherein said segregation disks are formed of a polymeric material.

6. A multi-chambered storage container system according to claim 5, wherein said polymeric material is selected from the group rubber and plastic.

7. A method of separately storing a plurality of items in a container comprising the steps of:

a) providing tubular container including:

a generally circular cross-section and an open end for inserting items to be stored; and a plurality of segregation disks for segregating said container into multiple chambers, said segregation disks being generally planar disks having a diameter greater than that of said generally tubular container, formed of a bendable material and having a plurality of radial slits extending inwardly from a periphery of said disk to form a plurality of flexible wedges therein;

said generally tubular container having an open top end and a closed bottom end;

said generally tubular container is collapsible from top to bottom;

said generally tubular container comprises a plurality of accordion-like folds which enable it to collapse or expand from top to bottom;

each of said radial slits extends from a periphery of said disk to a terminus at an interior portion of said disk;

a tear break at each said terminus; and wherein each said tear break is a generally circular aperture;

b) inserting one or more first items into said container though said open end of said container to rest on said bottom end;

c) inserting a first one of said plurality of segregation disks into said open end of said container; and d) pushing said first segregation disk down said generally tubular container to cover said one or more first items.

8. The method according to claim 7, further comprising the steps of:

a) inserting one or more second items into said generally tubular container though said open end of said container to rest on said first segregation disk;

b) inserting a second one of said plurality of segregation disks into said open end of said generally tubular container; and c) pushing said second segregation disk down said generally tubular container to cover said one or more items.

9. The method according to claim 8, further comprising the iterative steps of adding items and covering said items with segregation disks.

10. The method according to claim 9, further comprising the step of removing an uppermost segregation disk by pulling said uppermost segregation disk out said open top end of said container by pulling on said pull tab.

11. The method according to claim 10, wherein said tubular container comprises a plurality of accordion-like folds which enable it to collapse or expand from top to bottom.

12. The method according to claim 11, wherein said items a selected from the group of candies, pills and tablets.

* * * * *